US009762999B1

(12) United States Patent
Johnson et al.

(10) Patent No.: US 9,762,999 B1
(45) Date of Patent: Sep. 12, 2017

(54) MODAL BASED ARCHITECTURE FOR CONTROLLING THE DIRECTIVITY OF LOUDSPEAKER ARRAYS

(71) Applicant: Apple Inc., Cupertino, CA (US)

(72) Inventors: Martin E. Johnson, Los Gatos, CA (US); Gordon R. Dix, Sunnyvale, CA (US); Vijay G. Prabakaran, Cupertino, CA (US); Tom-Davy William Jendrik Saux, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/869,760

(22) Filed: Sep. 29, 2015

Related U.S. Application Data

(60) Provisional application No. 62/057,989, filed on Sep. 30, 2014.

(51) Int. Cl.
*H04R 5/00* (2006.01)
*H04R 1/40* (2006.01)

(52) U.S. Cl.
CPC ..... *H04R 1/403* (2013.01); *H04R 2201/40* (2013.01)

(58) Field of Classification Search
CPC H04R 1/403; H04R 2201/41; H04R 2203/12; H04R 2430/20
See application file for complete search history.

(56) References Cited

U.S. PATENT DOCUMENTS

| | | | | |
|---|---|---|---|---|
| 7,319,641 | B2 * | 1/2008 | Goudie | H04R 1/403 367/138 |
| 8,150,068 | B2 * | 4/2012 | Konagai | H04R 1/403 381/17 |
| 8,345,883 | B2 * | 1/2013 | Takumai | H04R 3/12 381/1 |
| 8,391,521 | B2 * | 3/2013 | Takumai | H04R 3/12 381/17 |
| 8,675,899 | B2 * | 3/2014 | Jung | H04R 1/403 381/152 |
| 9,049,516 | B2 * | 6/2015 | Kim | H04R 3/12 |
| 9,124,978 | B2 * | 9/2015 | Konagai | H04R 1/403 |
| 2009/0003634 | A1 | 1/2009 | Kushida | |
| 2009/0034762 | A1 * | 2/2009 | Konagai | H04R 1/403 381/300 |
| 2009/0129602 | A1 | 5/2009 | Konagai et al. | |
| 2009/0136045 | A1 | 5/2009 | Kim et al. | |

(Continued)

*Primary Examiner* — Curtis Kuntz
*Assistant Examiner* — Ryan Robinson
(74) *Attorney, Agent, or Firm* — Blakely Sokoloff Taylor & Zafman LLP

(57) ABSTRACT

A directivity pattern generator for producing sound patterns using a modal architecture is described. The directivity pattern generator may include a beam pattern mixing unit, which defines sound patterns to be emitted by an audio system in terms of a set of frequency invariant modes or modal patterns. The beam pattern mixing unit produces a set of modal gains representing the level or degree each of the predefined modal patterns is to be applied to a set of audio streams. Modal filters may be used to modal amplitudes that compensate for inefficiencies of the each modal pattern at low frequencies. The directivity pattern generator may include a modal decomposition unit for generating driving signals for each transducer in one or more loudspeaker arrays based on weighted values for the modal gains/amplitudes.

20 Claims, 12 Drawing Sheets

(56) References Cited

U.S. PATENT DOCUMENTS

| | | | | |
|---|---|---|---|---|
| 2009/0290064 | A1* | 11/2009 | Matsumoto | H04S 3/00 348/515 |
| 2012/0051568 | A1 | 3/2012 | Kim et al. | |
| 2014/0056430 | A1* | 2/2014 | Choi | H04S 5/00 381/17 |
| 2015/0237446 | A1* | 8/2015 | Katayama | H04R 1/323 381/163 |

* cited by examiner

MODAL BASED ARCHITECTURE FOR CONTROLLING THE DIRECTIVITY OF LOUDSPEAKER ARRAYS

This application claims the benefit of U.S. Provisional Patent Application No. 62/057,989, filed Sep. 30, 2014, and this application hereby incorporates herein by reference that provisional patent application.

A sound system is provided for controlling the directivity of sound produced by loudspeaker arrays by processing audio streams in a modal based architecture. Other embodiments are also described.

BACKGROUND

Loudspeaker arrays may emit sound using various directivity/beam patterns. The directivity patterns may cause sound to be aimed with different densities, shapes, and along different paths into a room or listening area. For example, an omnidirectional directivity pattern emits sound uniformly throughout a room while a highly directed cardioid pattern emits sound primarily at a target.

Each stream or channel in a piece of sound program content may be driven using a different directivity pattern. For example, speech in a first stream of audio may utilize a highly directed pattern, while background music in a second stream may utilize a less directed pattern. Audio systems may process each audio stream with separate filters to form each respective directivity pattern. Although production of multiple types/styles of directivity patterns may allow separate channels or components of a piece of sound program content to be accurately represented to a user or set of users, processing using separate filters for each stream and/or transducer combination may be overly complex and inefficient.

The approaches described in this section are approaches that could be could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

In one embodiment of the invention a directivity pattern generator generates sound patterns using a mode based architecture. The directivity pattern generator may include a beam pattern mixing unit, which defines sound patterns to be emitted by an audio system in terms of a set of frequency invariant modes or modal patterns. The modal patterns are basic building blocks upon which other sounds patterns may be defined. In one embodiment, the beam pattern mixing unit multiplies audio samples from a set of audio streams with a beam pattern matrix that includes a set of weights for each of the predefined modal patterns. The multiplication produces a set of modal gains representing the level or degree each of the predefined modal patterns is to be applied to each of the audio streams to achieve corresponding directivity/beam patterns for each stream.

The modal gains may be processed by dedicated modal filters that compensate for inefficiencies in the modal patterns at low frequencies. In some embodiments, separate modal filters may be provided for each ring of transducers in a loudspeaker array since the compensation provided by the modal filters are a function of the diameter of the ring of transducers. The modal filters may produce a set of modal amplitudes, included in a modal amplitude matrix, that are processed by a modal decomposition unit. The modal decomposition unit defines the relationship between each modal pattern and each transducer in a loudspeaker array. Namely, the modal decomposition unit includes a modal decomposition matrix that includes weighting values for each modal pattern and transducer combination.

In some embodiments, the directivity pattern generator may include include additional filters to provide vertical sound control and transducer matching. In some embodiments, separate vertical control and matching filters may be provided for each transducer in a loudspeaker array. In other embodiments, in which the loudspeaker array includes multiple horizontal rings of identical transducers, the vertical control and matching filters may be combined with the modal filters.

The modal architecture described above simplifies the production of sound patterns by reducing processing elements while increasing flexibility. For example, alteration of sound patterns according to room or sound program dynamics may be achieved through the adjustment of values in the beam pattern matrix corresponding to defined modal patterns. Similarly, adjustment of sound output by a loudspeaker array may be accomplished by altering values in the modal decomposition matrix for each modal pattern. This modal pattern based architecture for sound generation provides a flexible streamlined approach while requiring a reduced set of processing/filtering elements.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
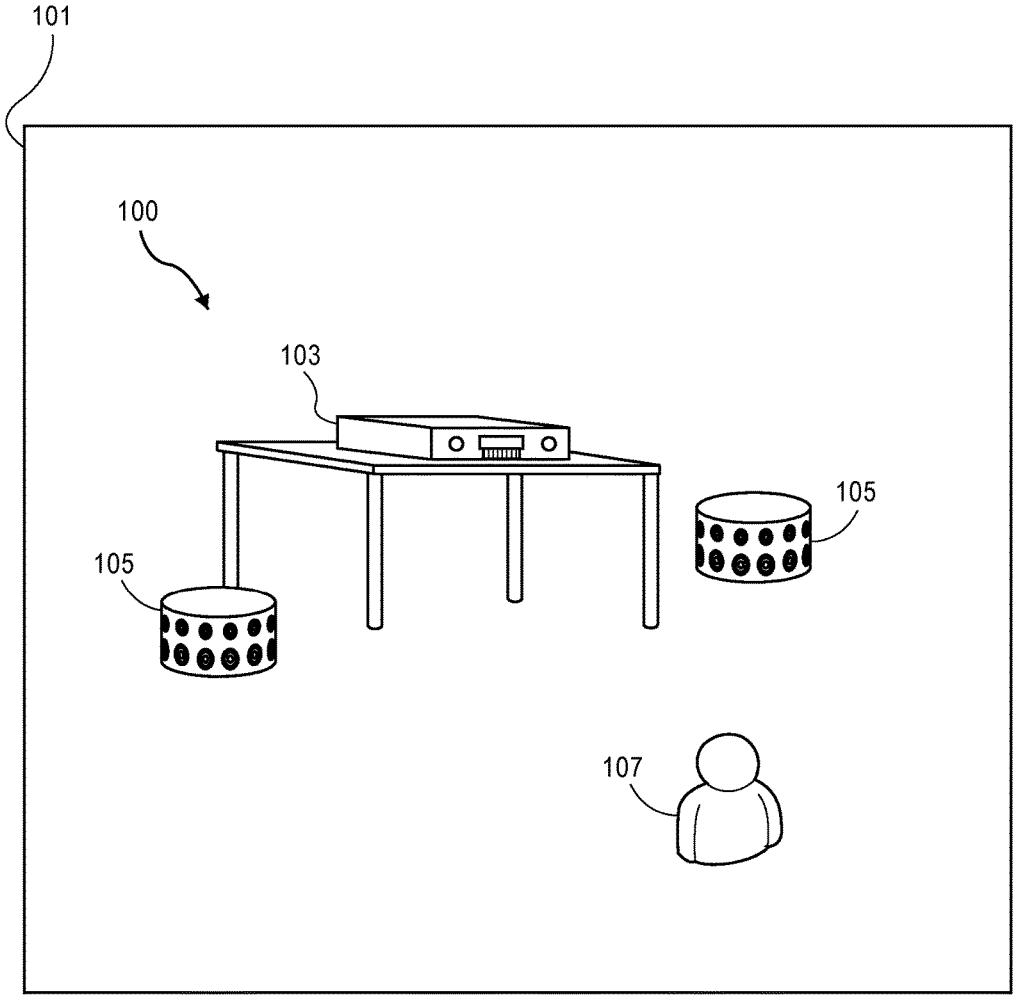
FIG. 1 shows a personal audio system that includes an audio receiver and one or more loudspeaker arrays according to one embodiment.

FIG. 1 shows an audio system 100 operating within a listening area 101. The audio system 100 may include an audio receiver 103 and one or more loudspeaker arrays 105. A listener 107 may be seated in the listening area 101 at a target location at which the audio system 100 is primarily directed or aimed. The target location is typically in the center of the listening area 101, but may be in any designated region of the listening area 101. As will be described in further detail below, the audio receiver 103 may use a set of sound/beam modes or modal patterns to drive transducers in the loudspeaker arrays 105 to produce one or more desired output patterns. By defining and representing the desired output patterns in terms of a set of predefined beam pattern modes, the audio receiver 103 may more efficiently process corresponding audio streams of sound program content played by the audio system 100 as will be described in greater detail below.

Each element of the audio system 100 will now be described by way of example. In some embodiments, the audio system 100 may include more or less components than those shown in FIG. 1 and described herein.

Figure 2:
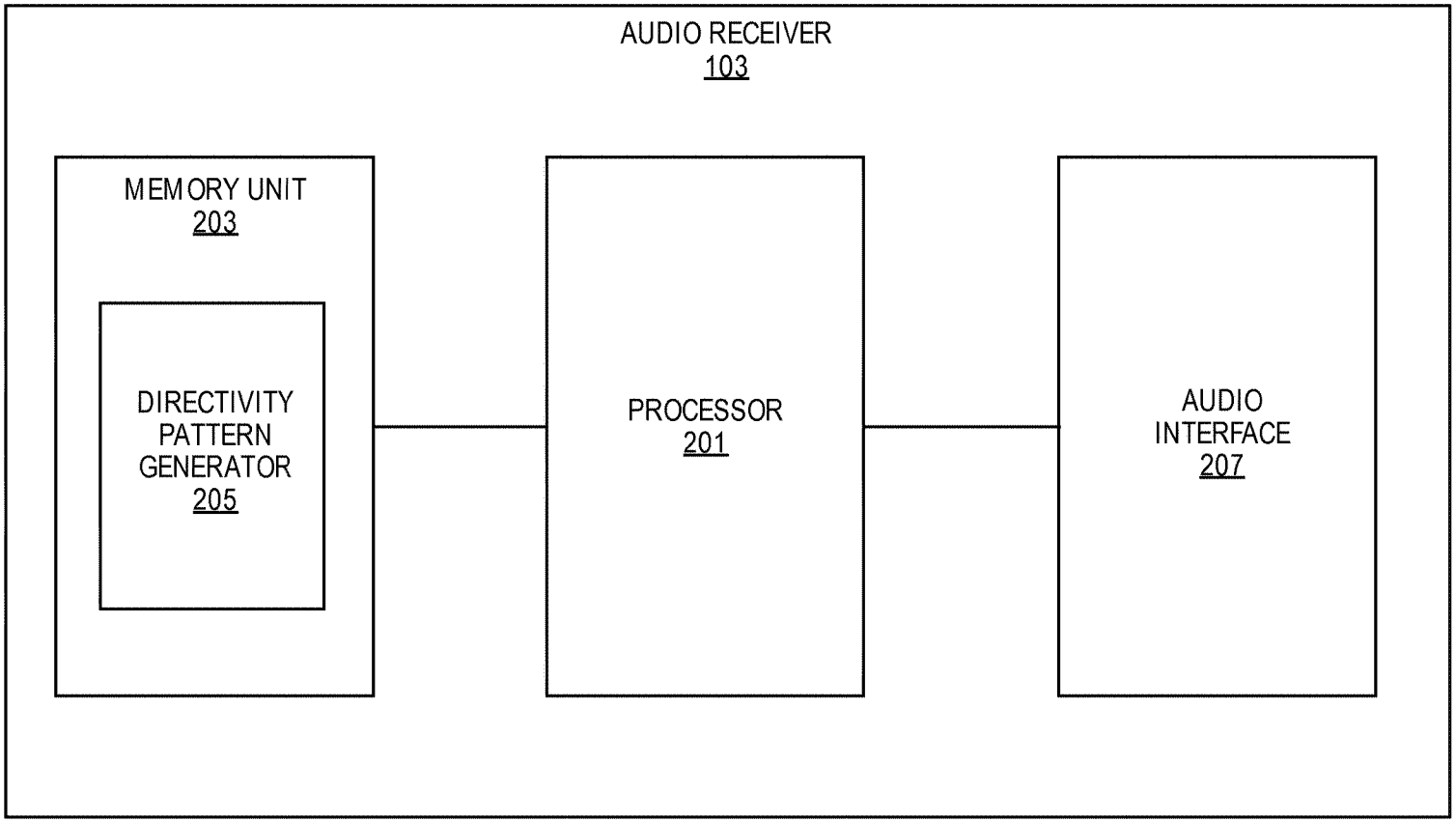
FIG. 2 shows a component diagram of the audio receiver according to one embodiment.

FIG. 2 shows a component diagram of the audio receiver 103 according to one embodiment. The audio receiver 103 may be any audio computing device that is configured to receive one or more pieces of sound program content and drive sets of transducers in the loudspeaker arrays 105 to produce one or more sound/beam patterns. For example, the audio receiver 103 may be a desktop computer, a laptop computer, a tablet computer, a home theatre receiver, or any other similar audio device.

As shown in FIG. 2, the audio receiver 103 may include a main system processor 201 and a memory unit 203. The processor 201 and memory unit 203 are generically used here to refer to any suitable combination of programmable data processing components and data storage that conduct the operations needed to implement the various functions and operations of the audio receiver 103. The processor 203 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines) while the memory unit 203 may refer to microelectronic, non-volatile random access memory. An operating system may be stored in the memory unit 203, along with application programs specific to the various functions of the audio receiver 103, which are to be run or executed by the processor 201 to perform the various functions of the audio receiver 103. For example, the audio receiver 103 may include a directivity pattern generator 205. Although described as a software component stored in the memory unit 203 and executed by the processor 201, in some embodiments the directivity pattern generator 205 may be implemented/represented by hardware logic structures and/or filters (e.g., Finite Impulse Response (FIR) filters) that perform the operations and functions described herein.

In one embodiment, the audio receiver 103 may also include an audio interface 207. The audio interface 207 may facilitate the transfer of data (e.g., sound program content) between one or more external/remote devices and the audio receiver 103. The audio interface 207 may operate using one or more network standards and/or protocols. For example, the audio interface 207 may operate using any combination of wired and wireless protocols and standards, including the IEEE 802.11 suite of standards, IEEE 802.3, cellular Global System for Mobile Communications (GSM) standards, cellular Code Division Multiple Access (CDMA) standards, Long Term Evolution (LTE) standards, and/or Bluetooth standards.

Although described as receiving sound program content from a remote or external source, in some embodiments sound program content may be stored on the audio receiver 103. For example, sound program content (e.g., a musical composition or a track for a film) may be stored in the memory unit 203 and retrieved for playback through the one or more loudspeaker arrays 105.

In one embodiment, the audio interface 207 may also be used for establishing a connection between the audio device 103 and the one or more loudspeaker arrays 105. For example, the audio interface 207 may be used for establishing a wired or wireless connection between the audio receiver 103 and the one or more loudspeaker arrays 105 such that the audio receiver 103 may drive transducers in the loudspeaker arrays 105 to produce one or more beam patterns as will be described in greater detail below.

Figure 3A:
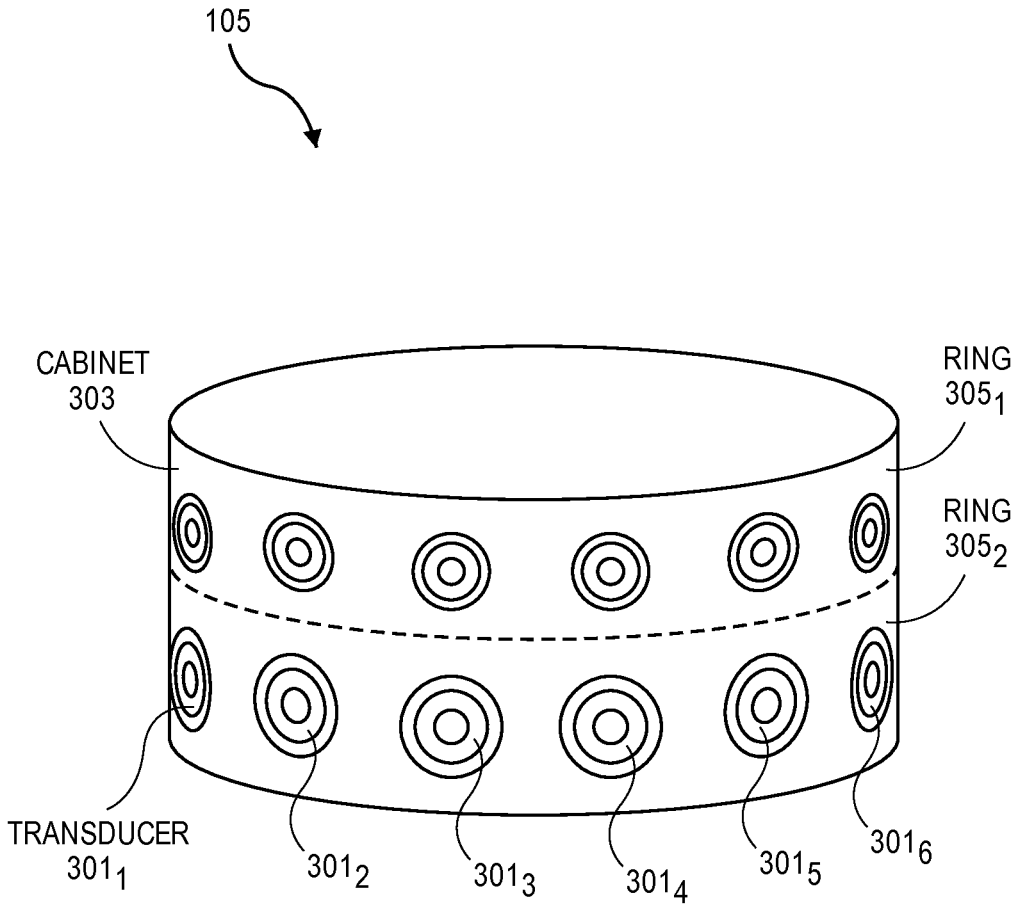
FIG. 3A shows a front view of one loudspeaker array with multiple transducers housed in a single cabinet.
Figure 3B:
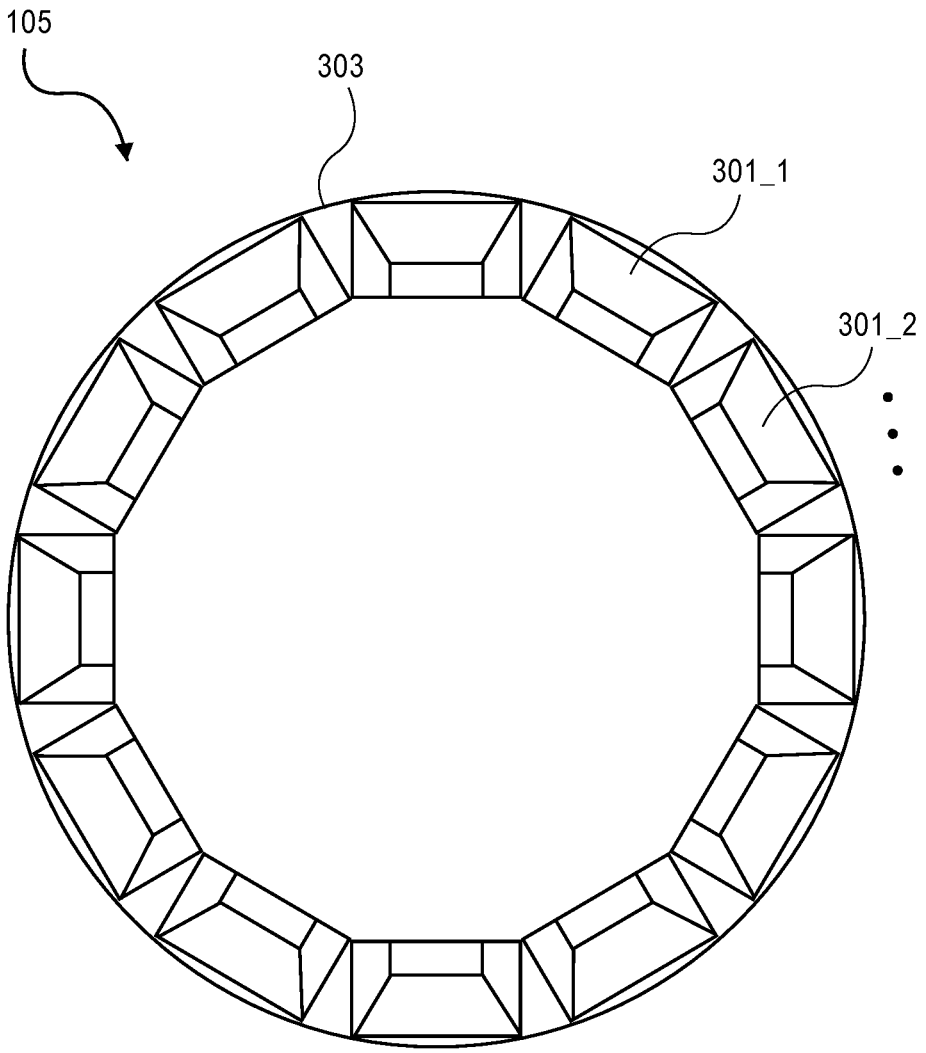
FIG. 3B shows a top cutaway view of the loudspeaker array with the multiple transducers arranged around the cabinet.

Turning now to the loudspeaker arrays 105, FIG. 3A shows a front view of one loudspeaker array 105 with multiple transducers 301_1, 301_2, . . . housed in a single cabinet 303. FIG. 3B shows a top cutaway view of the loudspeaker array 105 from FIG. 3A with the multiple transducers 301 arranged around the cabinet 303. In these examples, the cabinet 303 is cylindrical; however, any shape may be used for the cabinet 303, including other curved shapes (e.g., a sphere). As shown in FIGS. 3A and 3B, the transducers 301 are aligned in an arc forming rings 305_1, 305_2 around the curved surface of the cabinet 303. Although two rings 305 are shown, the techniques described here are also applicable to a cabinet 303 that has more than two such rings 305 (which may be stacked in the same cabinet 303.) The transducers 301 may be any combination of full-range drivers, mid-range drivers, subwoofers, woofers, and tweeters, e.g. a lower ring of mid-range drivers and an upper ring of tweeters. Each of the transducers 301 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 301 magnetic system interact, generating a mechanical force that causes the coil (and thus, the attached cone) to move back and forth, thereby reproducing sound under the control of the applied electrical audio signal coming from a source, such as the audio receiver 103.

As will be described in greater detail below, each transducer 301 may be individually and separately driven to produce sound in response to separate and discrete audio signals. By allowing the transducers 301 in each of the loudspeaker arrays 105 to be individually and separately driven according to different parameters and settings (including delays, phases, energy/gain levels, etc.), the loudspeaker arrays 105 may produce numerous directivity/beam sound patterns to simulate or better represent respective channels/streams of sound program content played in the listening area 101 by the audio system 100.

Although shown in FIG. 1 as being wirelessly connected to the audio receiver 103, the loudspeaker arrays 105 may include wires or conduit for connecting to the audio receiver 103. For example, each loudspeaker array 105 may include two wiring points and the audio receiver 103 may include complementary wiring points. The wiring points may be binding posts or spring clips on the back of the loudspeaker arrays 105 and the audio receiver 103, respectively. The wires may be separately wrapped around or otherwise coupled to respective wiring points to electrically couple the loudspeaker arrays 105 to the audio receiver 103.

Although shown as separate and distinct, in some embodiments one or more components of the audio receiver 103 may be integrated within one or more of the loudspeaker arrays 105. For example, the directivity pattern generator 205 may be integrated within the speaker cabinet of a loudspeaker array 105 to process one or more audio streams as will be described below.

In some embodiments, the loudspeaker arrays 105 may include integrated amplifiers for driving the transducers 301 using audio signals received from the audio receiver 103. As noted above, the loudspeaker arrays 105 may be standalone units that include components for signal processing and driving each transducer 301 according to the techniques described below.

Although shown as including two loudspeaker arrays 105, the audio system 100 may include any number of loudspeaker arrays 105. For example, the audio system 100 may include six loudspeaker arrays 105 that represent a front left channel, a front center channel, a front right channel, a rear right surround channel, a rear left surround channel, and a low frequency channel, respectively. In another example, the audio system 100 may include a single loudspeaker array 105 that represents multiple separate channels for a piece of sound program content.

Figure 4A:
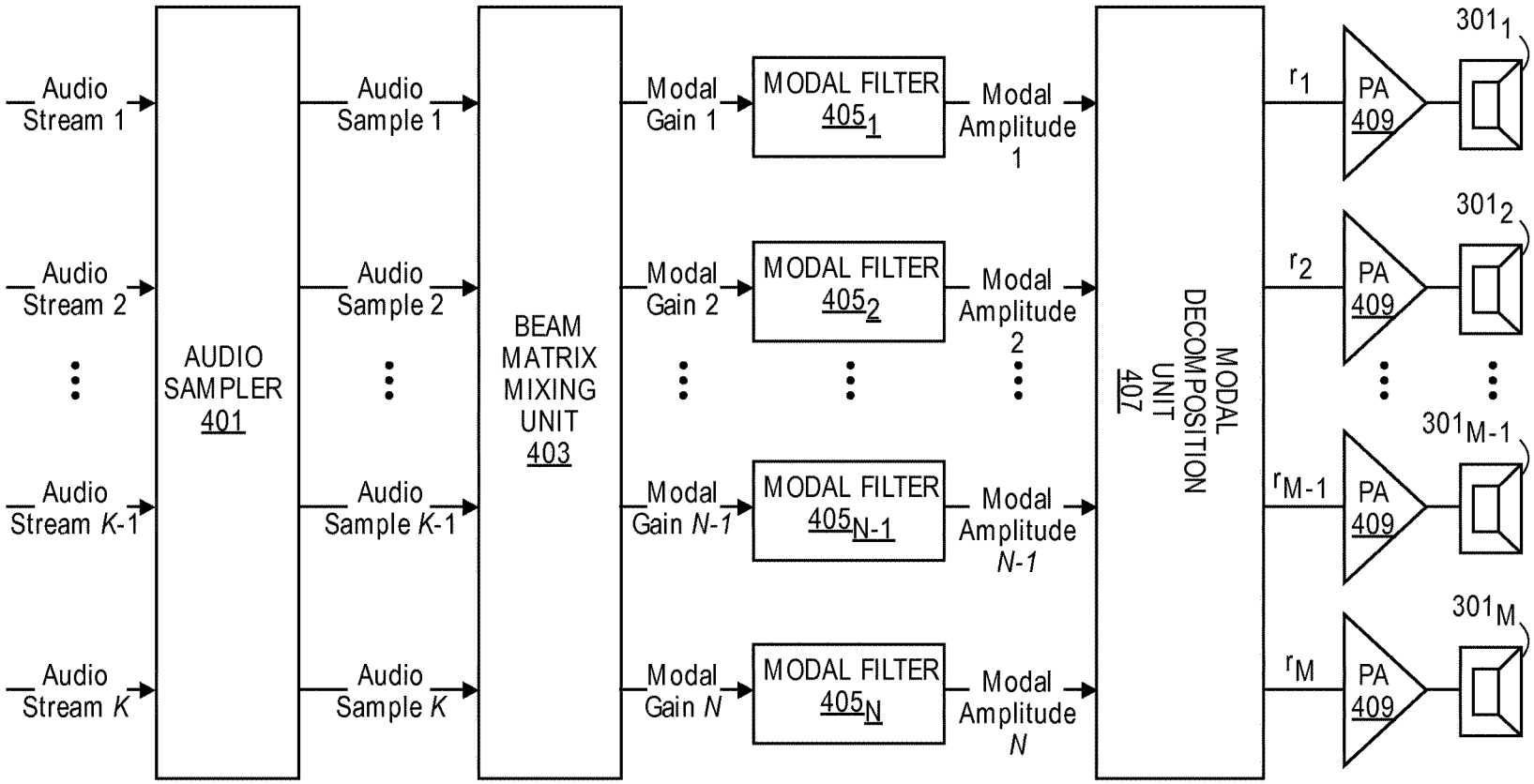
FIG. 4A shows a component diagram of a directivity pattern generator according to one embodiment.

As noted above and shown in FIG. 2, in one embodiment, the audio receiver 103 may include a directivity pattern generator 205. FIG. 4A shows a component diagram of the directivity pattern generator 205 according to one embodiment. Each element of the directivity pattern generator 205 shown in FIG. 4A will be described below by way of example. In other embodiments, the directivity pattern generator 205 may include additional components not shown. Each element of the directivity pattern generator 205 may be implemented by one or more processors, filters, programmable gates, or other structures.

In the description that follows, a single loudspeaker array 105 will be used for describing the functionality of the directivity pattern generator 205. However, in other embodiments the directivity pattern generator 205 may be used to simultaneously drive multiple loudspeaker arrays 105 in a similar fashion.

In one embodiment, the directivity pattern generator 205 may receive/retrieve a piece of sound program content for playback through a loudspeaker array 105. The piece of sound program content may be received/retrieved from another component of the audio receiver 103 (e.g., a local memory unit) or from an external audio source (e.g., a television, an MP3 player, or a streaming music service). For example, the audio interface 207 of the audio receive 103 may include one or more digital inputs for receiving electrical, optical (e.g., TOSLINK), or radio (e.g., WiFi or Bluetooth) digital audio signals. The digital audio signals may include multiple encoded audio streams representing separate channels for the piece of sound program content (e.g., left, right, and center channels for a file soundtrack). For example, a decoder in the audio receiver 103 may decode a received digital audio signal into six audio streams (e.g., a 5.1 signal). The decoder may be capable of decoding an audio signal encoded using any codec or technique including Advanced Audio Coding (AAC), MPEG Audio Layer II, MPEG Audio Layer III, and Free Lossless Audio Codec (FLAC).

In another embodiment, the audio interface 207 of the audio receiver 103 may include one or more analog inputs for receiving analog signals from an external audio source. Each analog signal received by the analog inputs may represent a single audio stream/channel and may be converted to a digital signal using an analog-to-digital converter.

In one embodiment, the directivity patter generator 205 may include an audio sampler 401 for sampling each audio stream for the received piece of sound program content (i.e., the reduction of the continuous audio streams into corresponding discrete-time signals) at a specified sampling period. For example, each sample may be a 1.0 millisecond section of an audio stream. Sampling may be performed using various rates (e.g., 44.1 kHz, 48 kHz, 96 kHz, and 192 kHz) and bit depths (e.g., 8, 16, and 20 bit depths).

The audio samples from each audio stream produced by the audio sampler 401 may be represented in a matrix or a similar data structure. For example, in FIG. 4A, samples from the K audio streams may be represented by the audio sample matrix X:

$$X_K=[x_1 \ldots x_K]$$

In the example audio sample matrix X, each value x represents a discrete time division of an audio stream. In one embodiment, the audio sample matrix X may be processed by a beam pattern mixing unit 403. The beam pattern mixing unit 403 may regulate the shape and direction of beam patterns for each audio stream. The beam patterns characterize how sound radiates from transducers 301 in the loudspeaker array 105 and into the listening area 101. For example, a highly directed cardioid beam pattern (having a "high" directivity index, DI) may emit a high degree of sound directly at the listener 107 or another specified area while emitting relatively lower amounts of sound into other areas of the listening area 101 in general (i.e., a low level of diffuse sound). In contrast, a lower directed beam pattern (e.g., "low" DI, such as an omnidirectional beam pattern) may emit a more uniform amount of sound throughout the listening area 101 without special attention to the listener 107 or any specified area. In these embodiments, the beam patterns may be formed along or lie in a horizontal plane, which is perpendicular to the upright stance of the loudspeaker array 105 (or a vertical center axis of the loudspeaker array 5). Accordingly, the beam patterns produced by the loudspeaker array 105 using the beam pattern mixing unit 403 in this embodiment may concentrate sound control in the horizontal direction without affecting the vertical directivity.

Figure 5C:
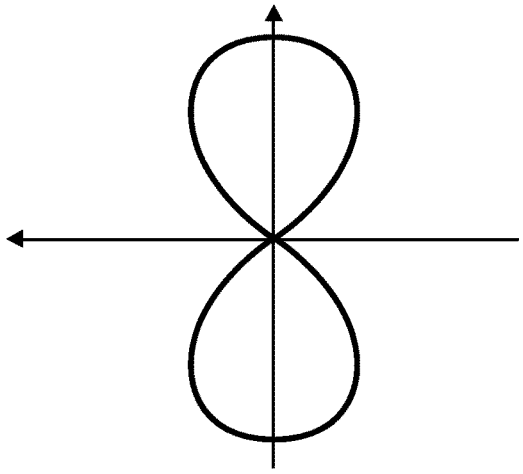
FIG. 5C shows a horizontal dipole modal pattern according to one embodiment.
Figure 5B:
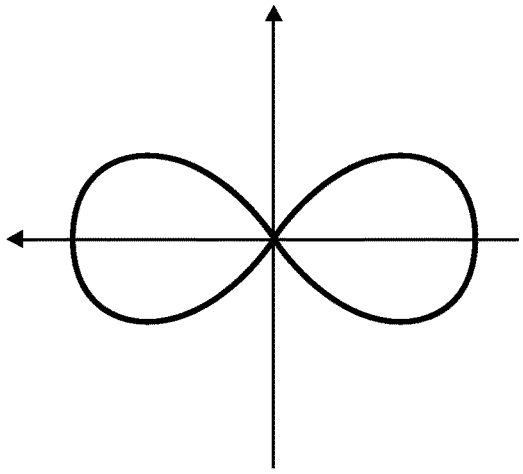
FIG. 5B shows a vertical dipole modal pattern according to one embodiment.
Figure 5A:
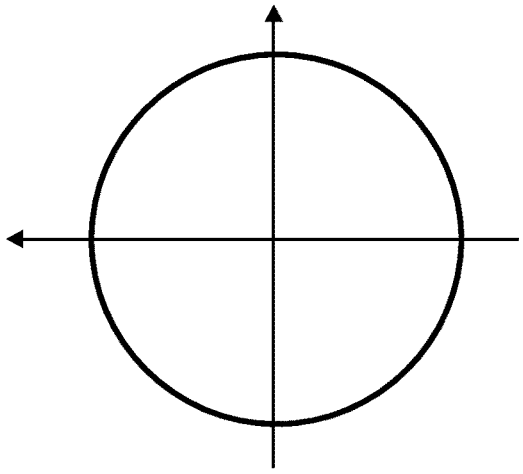
FIG. 5A shows an omnidirectional modal pattern according to one embodiment.

For a loudspeaker array 105 with transducers 301 arranged in a circular, cylindrical, spherical, or otherwise curved manner, radiation of sound may be represented by a set of frequency invariant sound/beam pattern modes. For example, the beam pattern mixing unit 403 may represent or define a set of desired beam patterns in terms of a set of predefined sound/beam pattern modes. For instance, the predefined pattern modes may include an omnidirectional pattern (FIG. 5A), a vertical dipole pattern (FIG. 5B), and a horizontal dipole pattern (FIG. 5C). For the omnidirectional pattern, sound is equally radiated in all directions relative to the outputting loudspeaker array 105. For the vertical dipole pattern, sound is radiated in opposite directions along a vertical axis and symmetrical about a horizontal axis. For the horizontal dipole pattern, sound is radiated in opposite directions along the horizontal axis and symmetrical about the vertical axis. Although described as including omnidirectional, vertical dipole, and horizontal dipole patterns, in other embodiments the predefined sound/beam pattern modes may include additional patterns, including higher order beam patterns. As will be used herein, the directivity pattern generator 205 may utilize N pattern modes that are each orthogonal to each other. In some embodiments, N may equal seven such that seven sound/beam pattern modes may be used by the directivity pattern generator 205.

Figure 6C:
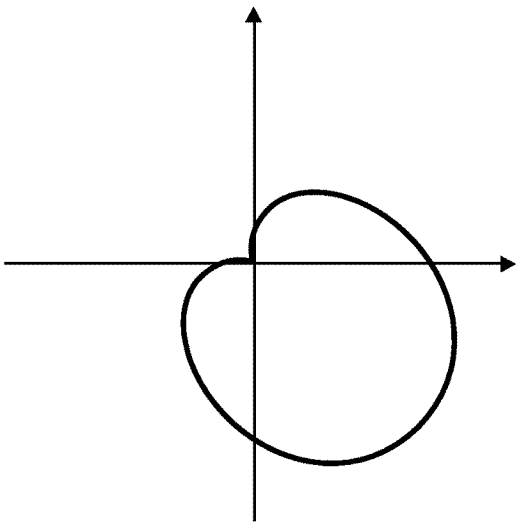
FIG. 6C shows a cardioid beam pattern pointed in a third direction based on a third set of weights applied to a set of modal patterns according to one embodiment.
Figure 6B:
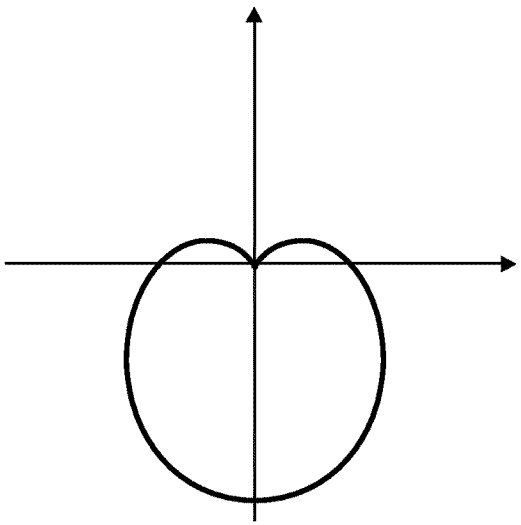
FIG. 6B shows a cardioid beam pattern pointed in a second direction based on a second set of weights applied to a set of modal patterns according to one embodiment.
Figure 6A:
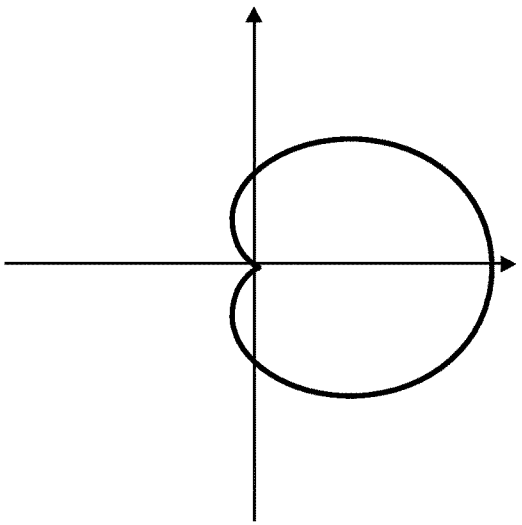
FIG. 6A shows a cardioid beam pattern pointed in a first direction based on a first set of weights applied to a set of modal patterns according to one embodiment.

The beam pattern mixing unit 403 may define a set of weighting values for each stream or each stream sample and each predefined pattern mode. The weighting values define the amount of each stream to apply to each of the pattern modes such that a corresponding desired directivity/beam pattern for the stream may be generated by the loudspeaker array 105. For example, through the setting of corresponding weighting values, an omnidirectional pattern mode may be mixed with a horizontal dipole pattern mode to yield a cardioid beam pattern directed to the right as shown in FIG. 6A. In another example, through the setting of corresponding weighting values, an omnidirectional modal pattern may be mixed with a vertical dipole modal pattern to yield a cardioid pattern directed downward at as shown in FIG. 6B. As shown and described, the combination or mixing of the predefined modal patterns may produce beam patterns with different shapes and directions for separate streams. Accordingly, the beam pattern mixing unit 403 may define a first set of weighting values for a first audio stream such that the loudspeaker array 105 may be driven to produce a first beam pattern while the beam pattern mixing unit 403 may also define a second set of weighting values for a second stream that the loudspeaker array 105 may be driven to produce a second beam pattern.

In one embodiment, the combination of the predefined pattern modes may be non-proportional such that more of one pattern mode may be used in comparison to another pattern mode to produce a desired beam pattern for an audio stream. In some embodiments, the weighting values defined by the beam pattern mixing unit 403 may be represented by any real numbers. For example, weighting values of $$\frac{1}{\sqrt{2}}$$

may be separately applied to a horizontal dipole pattern mode and a vertical dipole pattern mode while a weighting value of one is applied to an omnidirectional pattern mode. The mixing of these three variably weighted patterns modes may yield a cardioid pattern directed downward and to the right (i.e., at a 45° angle) as shown in FIG. 6C. Applying different proportions/weights of various pattern modes allows the generation of numerous possible beam patterns far in excess of the number of direct combinations of the predefined pattern modes.

As described above, different weighting values may be used to apply different levels of each predefined pattern mode to generate a desired beam pattern for a corresponding audio stream. In one embodiment, the beam pattern mixing unit 403 may use a beam pattern matrix Z that defines a beam pattern for each audio stream in terms of weighting values applied to the predefined N pattern modes. For example, each entry in the beam pattern matrix Z may correspond to a real number weighting value for a predefined pattern mode and a corresponding audio stream. For a set of N modal patterns and K audio streams, the beam pattern matrix $Z_{N,K}$ may be represented as:

$$Z_{N,K} = \begin{bmatrix} Z_{1,1} & \dots & Z_{N,1} \\ \vdots & \ddots & \vdots \\ Z_{1,K} & \dots & Z_{N,K} \end{bmatrix}$$

As previously described, each of the weighting values z represents the level or degree a predefined pattern mode is to be applied to a corresponding audio stream. In the above example matrix $Z_{N,K}$, each row represents the level or degree each of the N predefined pattern modes will be applied to a corresponding audio stream in the K received/retrieved audio streams. Each of the weighting values z may be preset by a user, an audio engineer, or the manufacturer of the audio receiver 103 or the loudspeaker array 105. In one embodiment, the weighting values z may be variable and relative to the sound program content played by the audio receiver 103 or the characteristics of the listening area 101. For example, a listening area 101 that is more reflective may require more directed beam patterns that avoid reflective surfaces in the listening area 101. In this instance, the weighting values in the beam pattern matrix Z may be set to favor more directed pattern modes or to avoid pattern modes that produce diffuse beam patterns. In another example, a first set of audio streams may primarily consist of dialogue while a second set of audio streams may primarily consist of music. In this example, the beam pattern mixing unit 403 may be set to produce more directed beam patterns (i.e., higher directivity indices) for the first set of audio streams while applying less directed beam patterns (i.e., lower directivity indices) for the second set of streams. This preference for beam patterns is reflected by corresponding weighting values z in the beam pattern matrix Z.

In one embodiment, the directivity pattern generator 205 may include equalizers for adjusting the sample audio signals according to the dynamics of the listening area 101. In one embodiment, the equalizers are adjusted as the weighting values z are changed to compensate for how the newly created beam patterns interact with the listening area 101.

The beam pattern mixing unit 403 may apply the beam pattern matrix Z to the audio streams by multiplying the audio stream sample matrix X with the beam pattern matrix Z as shown below:

$$[x_1 \ \dots \ x_K] \times \begin{bmatrix} Z_{1,1} & \dots & Z_{N,1} \\ \vdots & \ddots & \vdots \\ Z_{1,K} & \dots & Z_{N,K} \end{bmatrix} = [y_1 \ \dots \ y_N]$$

Multiplication of the beam pattern matrix Z and the audio stream sample matrix X yields a modal gain matrix Y, as shown in the above equation. This multiplication may be repeatedly performed for each sample period of the audio streams to yield a new modal gain matrix Y for each sample period. Each value y in the modal gain matrix Y represents gains corresponding to each of the audio streams that will be transmitted to corresponding modal filters 405, which each represent a corresponding predefined N pattern mode.

In one embodiment, each of the N modal filters 405 may compensate for radiation inefficiencies of sound at low frequencies for each corresponding pattern mode. In particular, higher order pattern modes and/or pattern modes with higher directivity indices may be harder to accurately produce at lower frequencies and typically require higher voltage drive signals to produce. Specifically, lower frequency sounds tend to diffuse into the listening area 101 instead of forming directed patterns. To compensate for these inefficiencies, the modal filters 405 may be linear digital filters that set their frequency responses to provide the needed boost at low frequencies. For instance, a modal filter 405 for a particular predefined pattern mode may boost the output power of a signal below a roll-off frequency for the pattern mode (i.e., the frequency level the power of the signal for the pattern mode drops off). Compensating for inefficiencies in pattern modes allows the pattern modes to be effectively and efficiently used at lower frequencies to produce more complex beam patterns (i.e., higher order patterns and/or beam patterns with higher directivity indices). In some embodiments, these modal filters 405 may be affected by the diameter of the cabinet 303 of the loudspeaker array 105. In particular, the distance between transducers 301 on opposite sides of the cabinet 303, which is defined by the diameter of the cabinet 303, may affect the efficiencies and shape of sound produced by sets of transducers 301. Thus, modal filter 405 settings may be adjusted according to the dimensions of the cabinet 303, including the diameter of the cabinet 303 proximate the location of transducers 301 controlled by a modal filter 405.

In one embodiment, the modal filters 405 may produce a matrix of modal amplitudes A that may be processed by the modal decomposition unit 407. The modal amplitude matrix A may be represented as shown below:

$$A=[a_1 \dots a_N]$$

The modal decomposition unit 407 may determine how each transducer 301 in the loudspeaker array 105 is to be driven to produce each of the predefined pattern modes. For example, for an omnidirectional pattern mode, each of the transducers 301 in the loudspeaker array 105 may be driven using the same driving signal. In contrast, a dipole modal pattern mode may require driving different sets of transducers 301 using driving signals and/or signals with varied weights.

In one embodiment, the modal decomposition unit 407 may include a modal decomposition matrix T that includes real numbers defining weights for each of the K modal patterns that correspond to each of the M transducers 301 in the loudspeaker array 105. The modal decomposition matrix T may be represented as:

$$T_{M,N} = \begin{bmatrix} t_{1,1} & \dots & t_{M,1} \\ \vdots & \ddots & \vdots \\ t_{1,N} & \dots & t_{M,N} \end{bmatrix}$$

In this example matrix T, each row represents a predefined pattern mode while each column represents a transducer 301 in the loudspeaker array 105. Each of the weights t in the modal decomposition matrix T may be applied to the modal amplitudes a in the modal amplitude matrix A to create drive signals for each transducer 301 in the loudspeaker array 105. For example, the below sample modal decomposition matrix T defines weighting values for four pattern modes and eight transducers 301 in a loudspeaker array 105:

$$\begin{bmatrix} 1 & 1 & 1 & 1 & 1 & 1 & 1 & 1 \\ 1 & 0 & -1 & 0 & 1 & 0 & -1 & 0 \\ 0 & 1 & 0 & -1 & 0 & 1 & 0 & -1 \\ 1 & \frac{1}{2} & 0 & -\frac{1}{2} & -1 & -\frac{1}{2} & 0 & \frac{1}{2} \end{bmatrix}$$

The weights t may be chosen to represent the arrangement of the transducers 301 in the loudspeaker array 105. For example, as shown in FIGS. 3A and 3B, the transducers 301 may be arranged generally in a ring, e.g., a circle, around the generally cylindrical cabinet 303 of the loudspeaker array 105. To accommodate for the positioning of the transducers 301 in a circle, the weights t for each column may correspond to different phases of a sine or a cosine curve. In one embodiment, the weights t are set during configuration of the audio system 100. In another embodiment, the manufacturer of the audio receiver 103 may preset the weighting values t for one or more different types of loudspeaker arrays 105 and room environments. For example, the manufacturer of the audio receiver 103 may preset one or more set of weighting values t corresponding to different loudspeaker array 105 types (e.g., model or design). A user of the audio receiver 103 may select one of the preset sets of weighting values t during configuration of the system 100.

To generate a set of driving signals for each transducer 301, the modal amplitude matrix A received from the modal filters 405 may be multiplied with the modal decomposition matrix T as shown below:

$$[a_1 \ \dots \ a_N] \times \begin{bmatrix} t_{1,1} & \dots & t_{M,1} \\ \vdots & \ddots & \vdots \\ t_{1,N} & \dots & t_{M,N} \end{bmatrix} = [r_1 \ \dots \ r_M]$$

The resulting driving signal matrix R includes separate driving signals r for each of the M transducers 301. By multiplying the modal amplitude matrix A with the modal decomposition matrix T, each of the driving signals r includes a weighted component of each predefined pattern mode. Accordingly, each transducer 301 may be driven to produce the desired beam patterns for each of the K audio streams by using components from each predefined pattern mode. The driving signals r may thereafter be output to power amplifiers 409 for driving corresponding transducers 301 in the loudspeaker array 105.

As described above, the audio system 100 may control the directivity of sound with a reduced number of pattern modes and modal filters 405. In particular, multiple audio streams may be simultaneously processed by the beam pattern mixing unit 403 to generate a single group of modal gains, which are thereafter passed to the single set of modal filters 405 for processing to produce modal amplitudes. The modal decomposition unit 407 may receive the modal amplitudes and decompose these amplitudes to individual drive signals for the transducers 301 such that each desired beam pattern for each audio stream may be produced. In comparison to traditional systems that require separate filters for each combination of audio streams and transducers (e.g., N×K modal filters 405), the above system 100 may utilize a single set of modal filters 405 corresponding to the number of pattern modes. Although this approach may require a reduced number of modal filters 405, sound control may be limited to the horizontal direction and may be limited to loudspeaker arrays 105 with a single type/model of transducer 301 that form rings with uniform diameters around the cabinet 303.

Figure 4B:
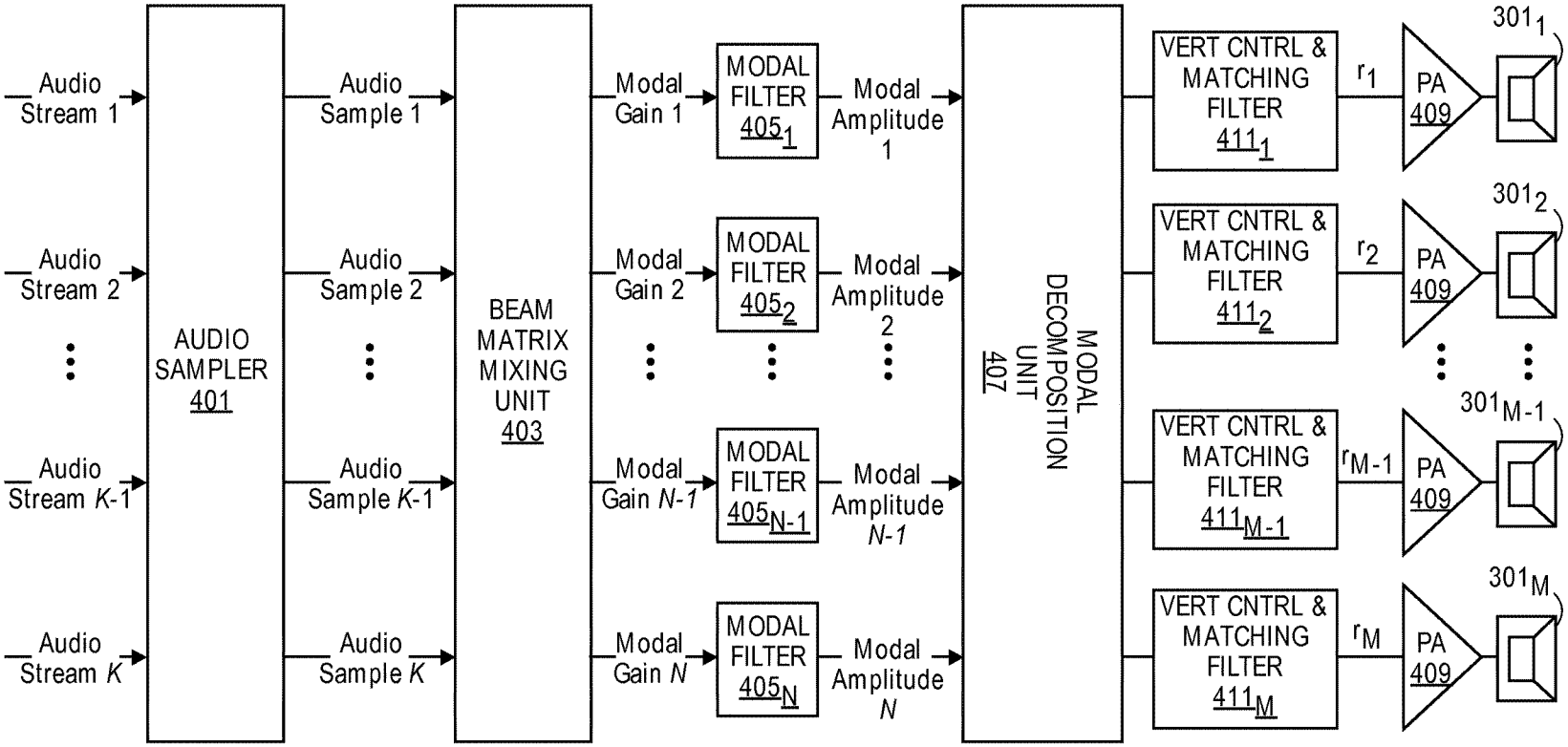
FIG. 4B shows a component diagram of the directivity pattern generator with vertical control and matching filters according to one embodiment.
Figure 7A:
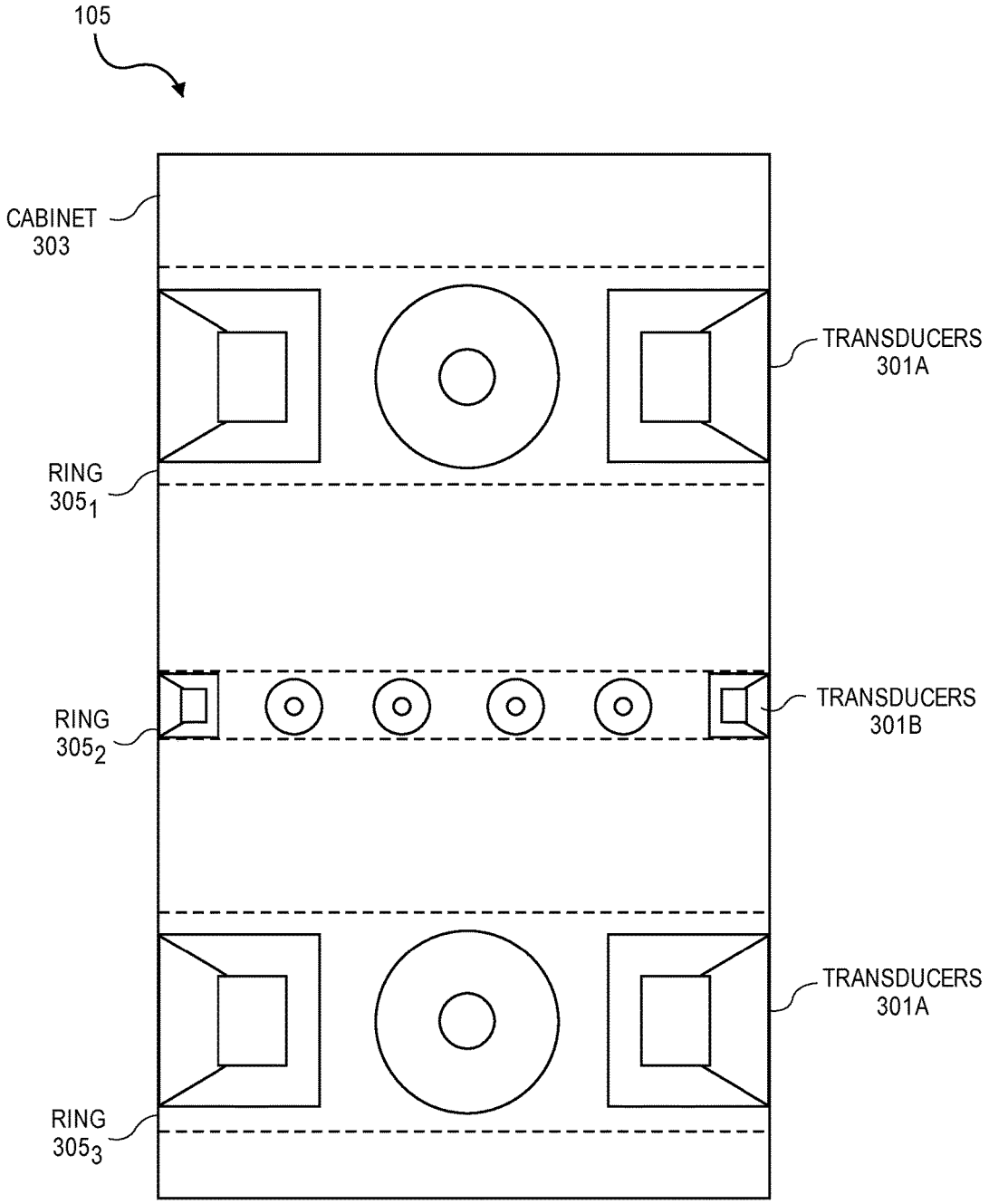
FIG. 7A shows a set of rings of transducers in a loudspeaker array according to one embodiment.

In one embodiment, the directivity pattern generator 205 may be used for a loudspeaker array 105 that includes transducers 301 of different types and provides vertical sound control. For example, FIG. 7A shows a side view of a loudspeaker array 105 that includes three rings 305_1, 305_2, 305_3 of different sized/type transducers 301 (but note that in general, there may be two or more rings 305). In particular, a set of at least two rings 305_1, 305_3 each made of transducers 301A may be placed around (above and below, and may be positioned concentric with) at least one ring 305_2 of transducers 301B as shown in FIG. 7A. In this embodiment, the transducers 301A may have diaphragms that have larger diameters than those of the transducers 301B. Accordingly, the transducers 301A may be more adept to handle lower frequency content (e.g., content below a cutoff frequency) and the transducers 301B may be more adept to handle higher frequency content (e.g., content above the cutoff frequency). Since the transducers 301A and 301B in this embodiment are different, the signals used to drive each of these styles of transducers 301A and 301B may be adjusted by a set of vertical control and matching filters 411 as shown in FIG. 4B. In this embodiment, a single vertical control and matching filter 411 may be provided for each of the M transducers 301 in the loudspeaker array 105. Settings for the vertical control and matching filter 411 for each of the transducers 301 may be adjusted according to the positioning of transducers 301 in the cabinet 303 and/or the type of the transducers 301. Adjustment of the settings may include one or more of delays, gains, phases, or other similar properties of signals used to drive each of the transducers 301. For example, staggered delays may be used by the vertical control and matching filters 411 such that sound produced by lower transducers 301 (in relation to placement in the cabinet 303 relative to a floor in the listening area 101) is delayed relative to higher transducers 301. This use of delays may cause sound produced by the loudspeaker array 105 to be directed upwards (relative to a floor in the listening area 101). In other embodiments, the vertical control and matching filters 411 may assist in matching sound produced by each of the transducers 301A and 301B such that the these transducers 301A/301B of different sizes/types may work together to form a single consistent set of audio beam patterns. Through use of the vertical control and matching filters 411 (1) directional control of sound produced by the loudspeaker array 105 may be provided in the vertical direction and (2) matching between transducers 301 of different types (e.g., the transducers 301A and 301B) may be provided such that multiple types/sizes of transducers 301 may work together to form a set of beam patterns for each input audio stream.

Figure 4C:
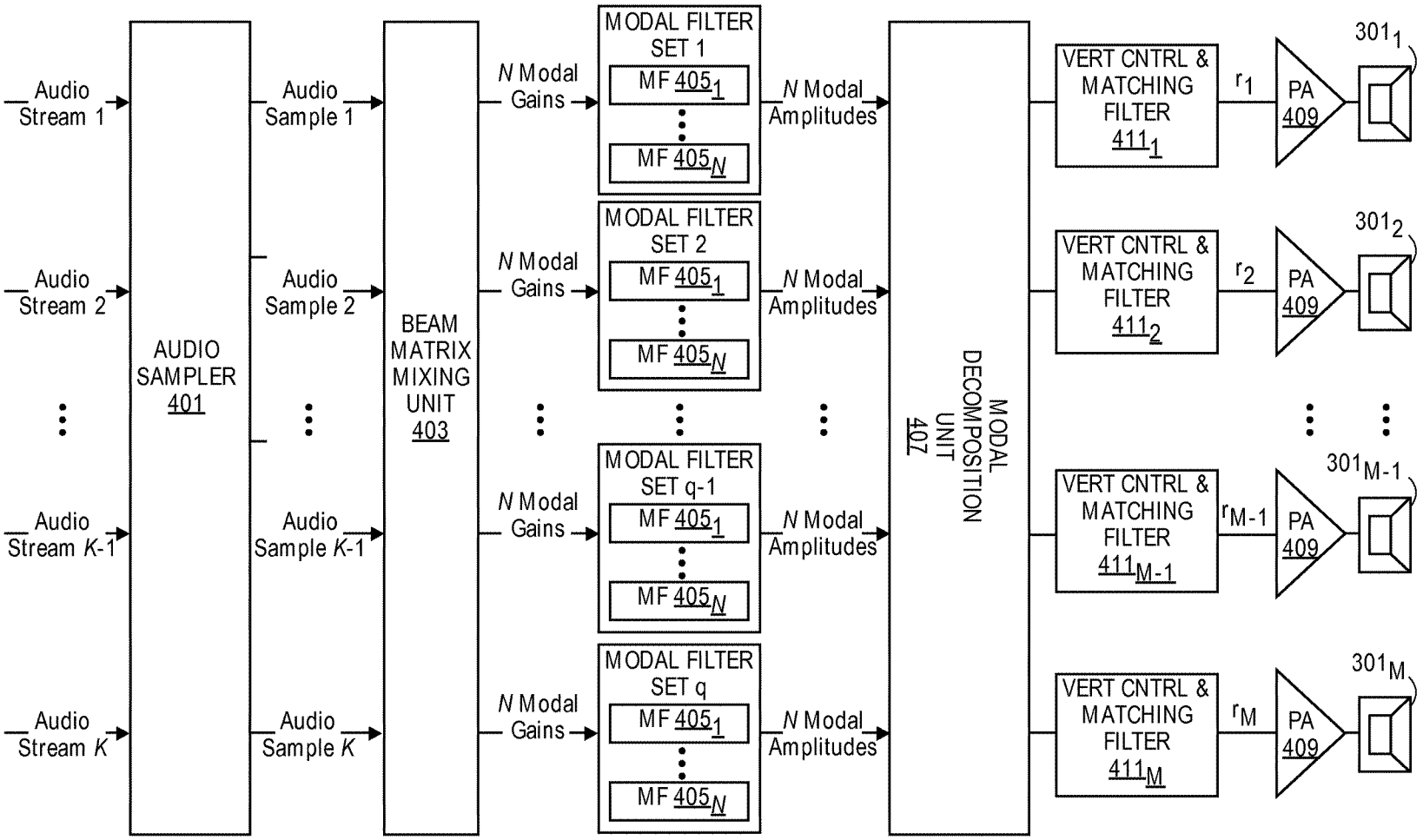
FIG. 4C shows a component diagram of a directivity pattern generator with vertical control and matching filters along with separate modal filters for separate rings of transducers in a loudspeaker array according to one embodiment.
Figure 7B:
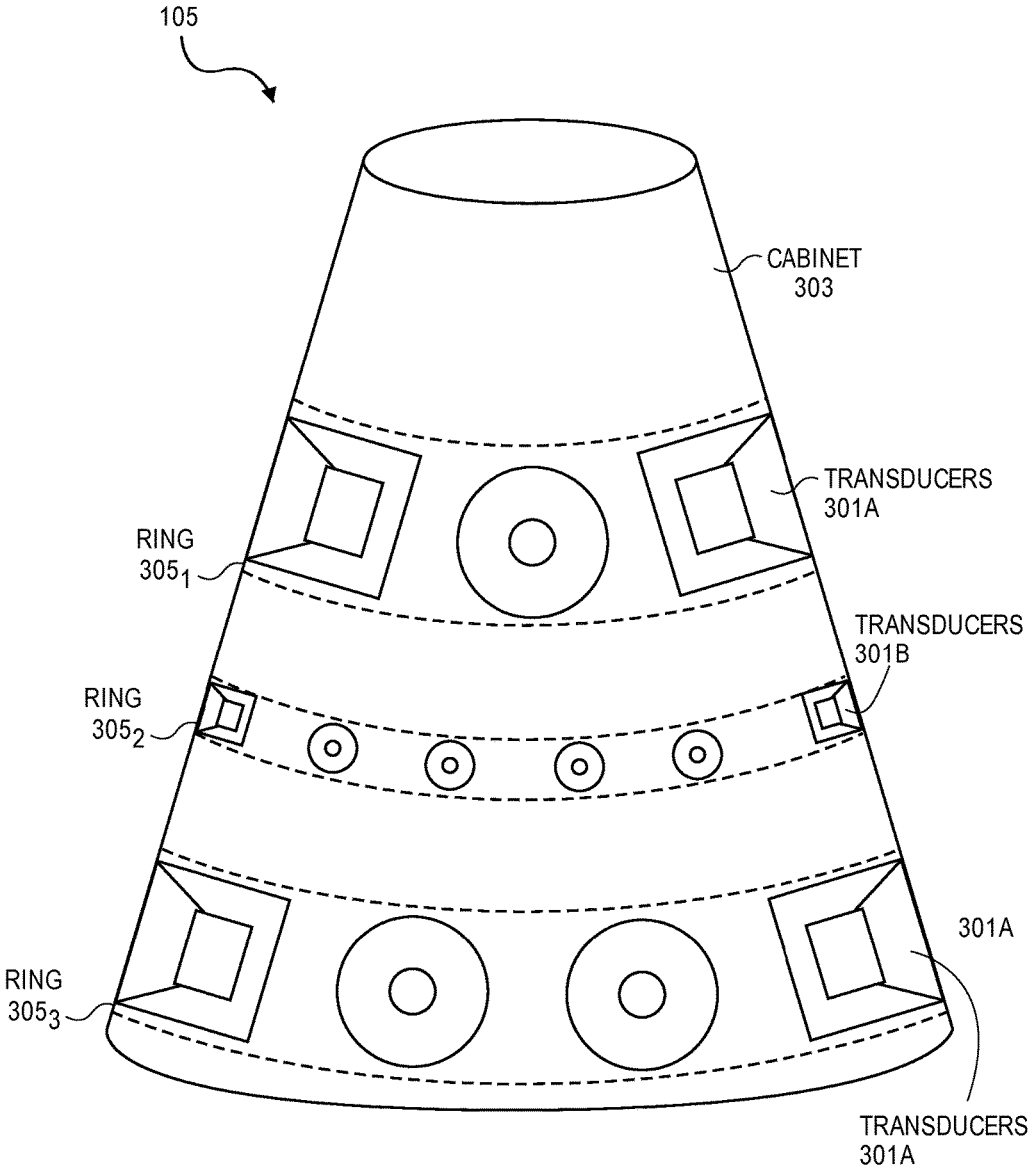
FIG. 7B shows a set of rings of transducers in a loudspeaker array with a sloped cabinet according to one embodiment.

Although shown in FIGS. 3A and 3B as having a uniform diameter along the vertical length of the cabinet 303, in some embodiments the cabinet 303 may have a non-uniform length. For example, cabinet 303 may form a frusto conical shape as shown in FIG. 7B. As noted above, the modal filters 405 may be operated based on the diameter of the cabinet 303. Since each of the rings 305_1, 305_2, 305_3 of transducers 301 in the loudspeaker array 105 shown in FIG. 7B may have different diameters based on the sloping nature of the cabinet 303 in this embodiment, separate modal filters 405 may be used for each ring 305_1, 305_2, 305_3 of transducers 301 as shown in FIG. 4C. In this embodiment, each of the modal filters 405 may be configured based on the diameter of the ring 305 of transducers 301 that the modal filter 405 is designed to control. Accordingly, each ring 305 of transducers 301 may be appropriately processed by corresponding modal filters 405 for variable diameter cabinets 303 to produce corresponding sets of modal amplitudes. The modal amplitudes for each set of modal filters 405 may thereafter be processed by the modal decomposition unit 407. In this embodiment, the modal decomposition matrix T of the modal decomposition unit 407 may be a block diagonal matrix as shown below:

$$\begin{bmatrix} \begin{bmatrix} t_{1,1(1)} & \cdots & t_{M,1(1)} \\ \vdots & \ddots & \vdots \\ t_{1,N(1)} & \cdots & t_{M,N(1)} \end{bmatrix} & \cdots & \begin{bmatrix} 0 & \cdots & 0 \\ \vdots & \ddots & \vdots \\ 0 & \cdots & 0 \end{bmatrix} \\ \vdots & \ddots & \vdots \\ \begin{bmatrix} 0 & \cdots & 0 \\ \vdots & \ddots & \vdots \\ 0 & \cdots & 0 \end{bmatrix} & \cdots & \begin{bmatrix} t_{1,1(q)} & \cdots & t_{M,1(q)} \\ \vdots & \ddots & \vdots \\ t_{1,N(q)} & \cdots & t_{M,N(q)} \end{bmatrix} \end{bmatrix}$$

In the example modal decomposition matrix T shown above, each block of values t along the diagonal may be used for each of the q rings 305 of transducers 301 in the loudspeaker array 105. Accordingly, by using separate sets of modal filters 405 based on the diameter of rings 305 of transducers 301, the directivity pattern generator 205 may compensate for inefficiencies of pattern modes in loudspeaker arrays 105 with sloped vertical cabinets 303.

Figure 4D:
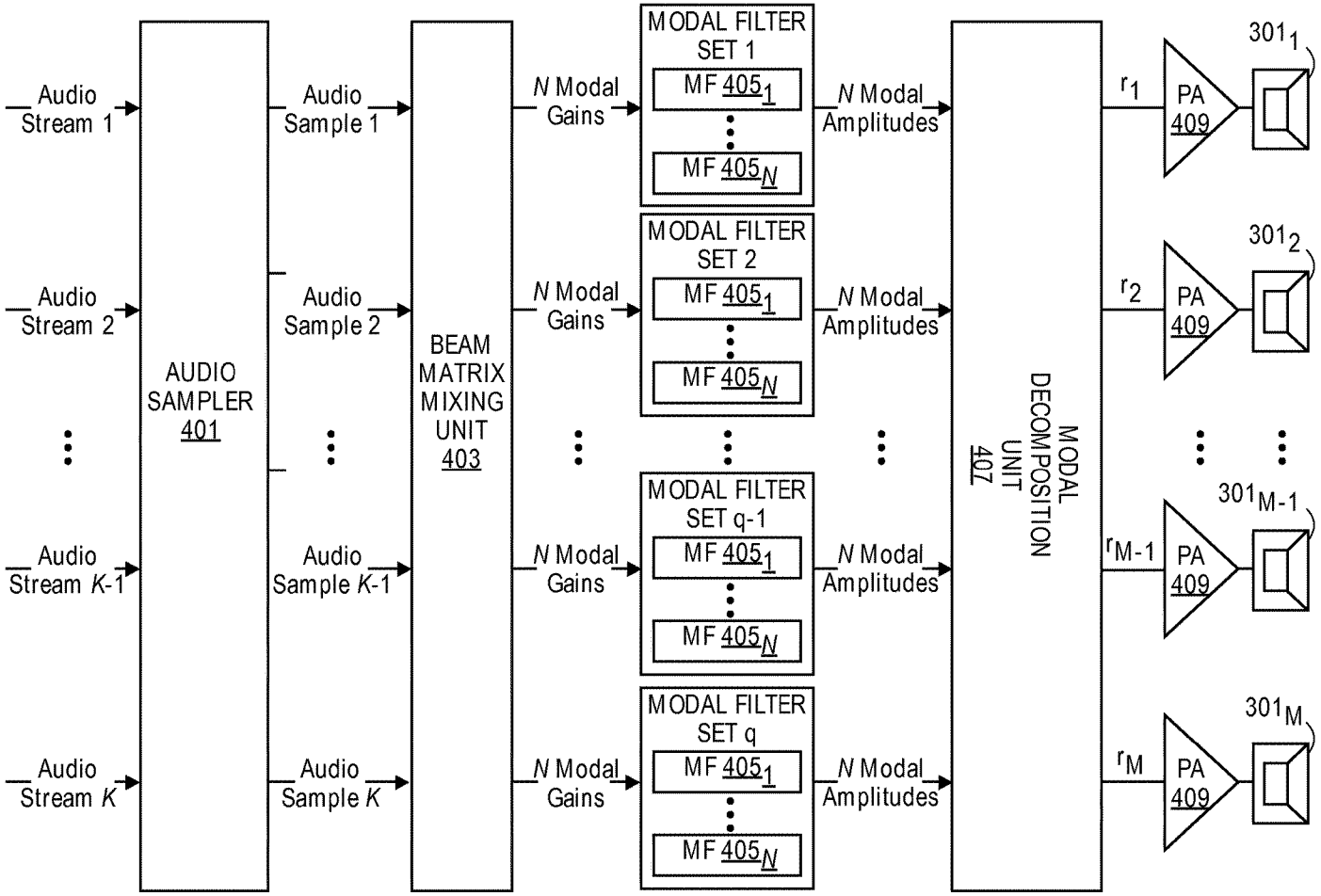
FIG. 4D shows a component diagram of a directivity pattern generator with vertical control and matching filters integrated within the ring based modal filters according to one embodiment.

In some embodiments, although the vertical control and matching filters 411 as show in FIG. 4C are provided for separate transducers 301, the settings/components of the these filters 411 are similar or identical for transducers 301 in the same ring 305. Namely, the transducers 301 in the same ring 305 have the same vertical separation from other transducers 301 and are of the same size/type. Accordingly, in one embodiment, as shown in FIG. 4D, the functions of the vertical control and matching filters 411 may be included inside the groups of modal filters 405. Since each of the groups of modal filters 405 control rings 305 of transducers 301 and as noted above vertical control and matching settings/components within a ring 305 are similar or identical, the combination of the vertical control and matching filters 411 with modal filters 405 still provides the same vertical control and matching between transducers 301 as in the directivity pattern generators 205 of FIG. 4C. However, the removal of the separate set of vertical control and matching filters 411 as shown in FIG. 4D reduces the total number of filters needed in the directivity pattern generator 205.

The modal architecture described above simplifies the production of sound patterns by reducing processing elements while increasing flexibility. For example, alteration of sound patterns according to room or sound program dynamics may be achieved through the adjustment of values in the beam pattern matrix corresponding to defined modal patterns. Similarly, adjustment of sound output by a speaker array may be accomplished by altering values in the modal decomposition matrix for each modal pattern. This modal pattern based architecture to sound generation provides a flexible streamlined approach while requiring a reduced set of processing elements.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for driving a loudspeaker array, comprising:

sampling one or more audio streams to produce a matrix of one or more audio samples; multiplying the matrix of one or more samples with a beam pattern mixing matrix, which represents a plurality of predefined modal patterns, to produce a modal gain value for each of the plurality of predefined modal patterns; and multiplying a matrix of the modal gain values with a modal decomposition matrix to produce a drive signal for each of a plurality of transducers in the loudspeaker array such that the loudspeaker array produces a separate output beam pattern for each of the one or more audio streams based on the plurality of predefined modal patterns.

2. The method of claim 1, wherein the beam pattern mixing matrix is a matrix of real numbers representing weights for the predefined modal patterns to produce the separate output beam pattern for each of the one or more audio streams.

3. The method of claim 1, wherein the modal decomposition matrix is a matrix of real numbers representing assignment levels for each predefined modal pattern to each transducer in the loudspeaker array such that the transducers in the loudspeaker array produce each of the predefined modal patterns based on weights represented in the beam pattern mixing matrix.

4. The method of claim 1, wherein the matrix of modal gain values includes individual real number coefficients for each of the predefined modal patterns.

5. The method of claim 1, further comprising:

filtering each modal gain value in the matrix of modal gain values, using a separate modal filter, wherein each modal filter corresponds to a separate modal pattern in the plurality of predefined modal patterns and each modal filter boosts a power level of a corresponding modal gain value below a roll-off frequency associated with a corresponding modal pattern.

6. The method of claim 5, wherein the modal gain values are separately filtered by multiple sets of modal filters, wherein each set of the modal filters includes a modal filter for each combination of 1) the plurality of predefined modal patterns and 2) each ring of transducers in the loudspeaker array, wherein each set of the modal filters is configured based on a diameter of a ring of transducers within the loudspeaker array controlled by the set of modal filters.

7. The method of claim 1, further comprising:

filtering the drive signals using a set of vertical control and matching filters, wherein a separate vertical control and matching filter is assigned to each transducer in the loudspeaker array, and each vertical control and matching filter adjusts a corresponding drive signal, to 1) provide vertical control to the output beam patterns and 2) match transducers of different size or type within the loudspeaker array.

8. The method of claim 6, wherein each set of modal filters further 1) provides vertical control to the output beam patterns and 2) matches transducers of different size or type within the loudspeaker array.

9. The method of claim 1, wherein the predefined modal patterns include a vertical dipole pattern, a horizontal dipole pattern, and an omnidirectional pattern.

10. A directivity pattern generator, comprising:

a beam pattern mixing unit to generate modal gains for predefined modal patterns by multiplying a matrix of weights corresponding to the predefined modal patterns with a matrix of audio samples for one or more audio streams; and a modal decomposition unit to generate drive signals corresponding to desired sound patterns by multiplying a matrix of the modal gains with a modal decomposition matrix to produce a drive signal for each of a plurality of transducers in a loudspeaker array such that the loudspeaker array produces a separate desired sound pattern for each of the one or more audio streams based on the predefined modal patterns, wherein the beam pattern mixing unit is coupled to the model decomposition unit.

11. The directivity pattern generator of claim 10, further comprising:

a sampler for sampling the one or more audio streams to generate the matrix of audio samples.

12. The directivity pattern generator of claim 10, further comprising:

modal filters to filter each modal gain in the matrix of modal gains using a separate modal filter, wherein each modal filter corresponds to a separate modal pattern in the predefined modal patterns and each modal filter boosts a power level of a corresponding modal gain below a roll-off frequency associated with a corresponding modal pattern.

13. The directivity pattern generator of claim 12, wherein the modal gains are separately filtered by multiple sets of modal filters, wherein each set of modal filters includes a modal filter for each combination of 1) the plurality of predefined modal patterns and 2) each ring of transducers in the loudspeaker array, wherein each set of modal filters is configured based on a diameter of a ring of transducers within the loudspeaker array controlled by the set of modal filters.

14. The directivity pattern generator of claim 10, further comprising:

a set of vertical control and matching filters to filter the drive signals, wherein a separate vertical control and matching filter is assigned to each transducer in the loudspeaker array, and each vertical control and matching filter adjusts a corresponding drive signal, to 1) provide vertical control to the output beam patterns and 2) match transducers of different size or type within the loudspeaker array.

15. The directivity pattern generator of claim 13, wherein each set of modal filters further 1) provides vertical control to the output beam patterns and 2) matches transducers of different size or type within the loudspeaker array.

16. An article of manufacture, comprising:

a non-transitory machine-readable storage medium that stores instructions which, when executed by a processor in a computing device, sample one or more audio streams to produce a matrix of one or more samples;

multiply the matrix of one or more samples with a beam pattern mixing matrix, which represents a plurality of predefined modal patterns, to produce a modal gain value for each of the plurality of predefined modal patterns; and multiply a matrix of the modal gain values with a modal decomposition matrix to produce a driving signal for each of a plurality of transducers in a speaker array to produce one or more output beam patterns.

17. The article of manufacture of claim 16, wherein the beam pattern mixing matrix is a matrix of real numbers representing weights for the predefined modal patterns to produce a separate output beam pattern for each of the one or more audio streams, wherein the matrix of the modal gain values includes individual real number coefficients for each of the predefined modal patterns, wherein the modal decomposition matrix is a matrix of real numbers representing assignment levels for each predefined modal pattern to each transducer in the loudspeaker array such that the transducers in the loudspeaker array produce each of the predefined modal patterns based on weights in the beam pattern mixing matrix.

18. The article of manufacture of claim 16, wherein the non-transitory machine-readable storage medium includes further instructions that when executed by the processor:

filter each modal gain value in the matrix of modal gain values using a separate modal filter, wherein each modal filter corresponds to a separate modal pattern in the plurality of predefined modal patterns and each modal filter boosts a power level of a corresponding modal gain below a roll-off frequency associated with a corresponding modal pattern.

19. The article of manufacture of claim 18, wherein the modal gain values are separately filtered by multiple sets of modal filters, wherein each set of the modal filters includes a modal filter for each combination of 1) the plurality of predefined modal patterns and 2) each ring of transducers in the loudspeaker array, wherein each set of the modal filters is configured based on a diameter of a ring of transducers within the loudspeaker array controlled by the set of modal filters.

20. The article of manufacture of claim 16, wherein the non-transitory machine-readable storage medium includes further instructions that when executed by the processor:

filter the drive signals using a set of vertical control and matching filters, wherein a separate vertical control and matching filter is assigned to each transducer in the loudspeaker array and each vertical control and matching filter adjusts a corresponding drive signal, to 1) provide vertical control to the output beam patterns and 2) match transducers of different size or type within the loudspeaker array.

* * * * *